US011013099B2

(12) United States Patent
Zierhut et al.

(10) Patent No.: US 11,013,099 B2
(45) Date of Patent: May 18, 2021

(54) METHOD AND DEVICE FOR COATING A SURFACE

(71) Applicant: Bayerische Motoren Werke Aktiengesellschaft, Munich (DE)

(72) Inventors: Jochen Zierhut, Munich (DE); Wolfram Wagener, Geisenhausen (DE); Ronald Goelz, Altdorf (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 334 days.

(21) Appl. No.: 15/814,664

(22) Filed: Nov. 16, 2017

(65) Prior Publication Data

US 2018/0077787 A1 Mar. 15, 2018

Related U.S. Application Data

(63) Continuation of application No. PCT/EP2016/068063, filed on Jul. 28, 2016.

(30) Foreign Application Priority Data

Jul. 30, 2015 (DE) ..... 10 2015 112 540.4

(51) Int. Cl.
*C23C 4/00* (2016.01)
*H05B 1/00* (2006.01)
(Continued)

(52) U.S. Cl.
CPC ..... *H05H 1/42* (2013.01); *B05B 7/1481* (2013.01); *B05B 13/0627* (2013.01);
(Continued)

(58) Field of Classification Search
CPC ..... C23C 4/00–185; H05H 1/42; H05H 1/26; B05B 7/1481; B05B 13/0627; F02F 1/186
See application file for complete search history.

(56) References Cited

U.S. PATENT DOCUMENTS 5,047,612 A * 9/1991 Savkar ..... C23C 4/12 219/121.47
5,242,110 A 9/1993 Riley
(Continued)

FOREIGN PATENT DOCUMENTS

DE 692 19 737 T2 11/1997
DE 198 20 195 A1 11/1999
(Continued)

OTHER PUBLICATIONS

International Search Report (PCT/ISA/210) issued in PCT Application No. PCT/EP2016/068063 dated Dec. 5, 2016 with English translation (seven pages).
(Continued)

*Primary Examiner* — Michael A Laflame, Jr.
(74) *Attorney, Agent, or Firm* — Crowell & Moring LLP

(57) ABSTRACT

A method for coating a surface with a coating jet containing coating particles includes forming the coating jet from at least two partial jets. The method also includes forming one of the exit channels as a spray channel for a first gas stream containing the coating particles. The method also includes forming the other of the exit channels as a control channel. In case of a deviation of the ascertained spray angle (α) from the predetermined target spray angle, the method also includes increasing the volume flow of a first partial jet of the at least two partial jets, and decreasing the volume flow of a second partial jet of the at least two partial jets.

17 Claims, 3 Drawing Sheets

(51) Int. Cl.

| | |
|---|---|
| ***B05B 7/14*** | (2006.01) |
| ***H05H 1/42*** | (2006.01) |
| ***B05B 13/06*** | (2006.01) |
| ***C23C 4/134*** | (2016.01) |
| ***F02F 1/18*** | (2006.01) |
| *H05H 1/34* | (2006.01) |

(52) U.S. Cl.
CPC ..... *C23C 4/134* (2016.01); *F02F 1/186* (2013.01); *H05H 2001/3494* (2013.01)

(56) References Cited

U.S. PATENT DOCUMENTS

| | | | | |
|---|---|---|---|---|
| 5,468,295 | A * | 11/1995 | Marantz | B05B 7/0861 118/300 |
| 5,908,670 | A * | 6/1999 | Dunkerley | B05B 7/224 219/76.14 |
| 6,967,304 | B2 * | 11/2005 | Gevelber | B05B 12/082 219/121.47 |
| 7,043,069 | B1 | 5/2006 | Heinrich et al. | |
| 2004/0245354 | A1 | 12/2004 | Srinivasan | |
| 2006/0198944 | A1 | 9/2006 | Gevelber et al. | |
| 2007/0158468 | A1 * | 7/2007 | Smith | C23C 4/12 239/423 |
| 2010/0108014 | A1 * | 5/2010 | Kodama | C22C 38/02 123/193.2 |
| 2010/0237048 | A1 * | 9/2010 | Brothier | F23G 5/085 219/121.5 |
| 2012/0121451 | A1 | 5/2012 | Kodama et al. | |
| 2018/0044785 | A1 * | 2/2018 | Qian | C23C 4/134 |

FOREIGN PATENT DOCUMENTS

| | | | |
|---|---|---|---|
| DE | 199 10 892 | A1 | 9/2000 |
| EP | 2 112 359 | A1 | 10/2009 |
| FR | 2 865 218 | A1 | 7/2005 |
| FR | 2 866 902 | A1 | 9/2005 |
| WO | WO 91/12183 | A1 | 8/1991 |

OTHER PUBLICATIONS

German-language Written Opinion (PCT/ISA/237) issued in PCT Application No. PCT/EP2016/068063 dated Dec. 5, 2016 (six pages).

German-language Search Report issued in counterpart German Application No. 10 2015 112 540.4 dated Jan. 20, 2016 with partial English translation (11 pages).

* cited by examiner

METHOD AND DEVICE FOR COATING A SURFACE

CROSS REFERENCE TO RELATED APPLICATIONS

This application is a continuation of PCT International Application No. PCT/EP2016/068063, filed Jul. 28, 2016, which claims priority under 35 U.S.C. § 119 from German Patent Application No. 10 2015 112 540.4, filed Jul. 30, 2015, the entire disclosures of which are herein expressly incorporated by reference.

BACKGROUND AND SUMMARY OF THE INVENTION

Embodiments of the present invention relate to a method for coating a surface by means of a coating jet containing coating particles, in which the coating jet is directed by a spray device at a spray angle onto the surface. Other embodiments relate to a device for coating a surface by means of a coating jet containing coating particles, in which the coating jet is directed by a spray device at a spray angle onto the surface, as well as to a surface coated in accordance with the inventive method.

The method of this kind may be used for the coating of a surface, in which the coating jet containing coating particles is directed by a spray device at a predetermined spray angle onto the surface being coated.

In the coating of structural parts, especially in a thermal coating process, one constantly strives for a uniform surface homogeneously coated in its quality. This applies in particular to the interior coating of cylinders of a piston and cylinder assembly, such as are provided for example in internal combustion engines. A critical quality criterion in such a coating process, especially a thermal coating process, is the angle of incidence of the coating jet on the surface being coated and optionally also the velocity of the coating particles of the coating jet. Due to wear, installation errors, confusion of parameters or incorrect operation it may be possible that the desired angle of incidence of the coating jet on the surface being coated is not correctly realized, even though all process and spray parameters have been set correctly. But as soon as the angle of incidence of the coating jet on the surface being coated lies outside predetermined limits, the quality of the surface coating is changed, since the impinging coating particles impinge on the surface at an unsuitable angle or with an unsuitable velocity. Such errors may result in the coated part being judged as a "reject" in the quality inspection, even though the process and spray parameters have been correctly set.

DE 199 10 892 A1 teaches to create a coating on the surface of a substrate by means of a thermal coating process, wherein at least one feature of the thermal spraying process which influences the quality of the spray layer is detected, controlled and/or monitored by means of a digital camera.

DE 198 20 195 A1 discloses and describes a method and a device for thermal spraying in which a powder being sprayed is admitted from above in a substantially horizontally extending plasma jet. A camera is used to monitor whether the powder introduced from above into the plasma jet has melted at the center of the plasma jet or—which is undesirable—has not penetrated into the plasma jet or has been blown through the plasma jet. The picture detected by the camera is used to adjust an optimal blowing of the powder into the plasma jet. No deflection of the plasma jet occurs in this case. However, it is mentioned in general that a digital camera can be used to detect, control and/or monitor at least one feature of the thermal spraying process influencing the quality of the spray layer, also mentioning incidentally as one such feature influencing the quality of the spray layer, among others, the spray angle as the angle between the spray jet and the substrate surface.

US 2006/0198944 A1 also discloses and describes a device for plasma spraying in which powder particles are admitted from the side into a plasma jet directed horizontally at a deposition surface. Owing to this sloping injection of the powder particles into the plasma jet, the powder particles which are melted in the plasma jet are sprayed at an angle onto the surface which deviates from the horizontal direction of the plasma jet.

U.S. Pat. No. 5,047,612 A likewise discloses and describes a plasma spray device in which powder particles being deposited on a surface are injected at an angle of 90° into a plasma jet directed horizontally onto the deposition surface. A camera is directed at the deposition surface and detects the powder deposited on the deposition surface.

US 2004/0245354 A1 discloses and describes a method for monitoring a spray process, wherein the particle distribution of a spray jet containing particles is determined by means of a particle analyzer.

SUMMARY OF THE INVENTION

The problem which the embodiments of the present invention solve is to indicate a method of this kind for the adjustment of a coating jet with which it is possible to improve the coating quality and in particular to obtain a surface uniformly coated through a coating process.

This problem is solved by a method for coating a surface by means of a coating jet containing coating particles, in which the coating jet is directed by a spray device at a spray angle onto the surface, the spray angle is ascertained during the coating process or between two coating processes and in event of a deviation of the ascertained spray angle from a predetermined target spray angle the spray angle is adjusted and thereby readjusted to the target spray angle. For this, it is provided that the coating jet is formed from at least two partial jets, each of which emerges from an exit opening of an associated exit channel of the spray device, in which the respective axes of the exit channels stand at an angle to each other, one of the exit channels is a spray channel for a first gas stream containing the coating particles, wherein the exit opening of this spray channel forms a spray nozzle directed at the surface being coated, the other of the exit channels is a control channel for a second gas stream deflecting the first gas stream, wherein the exit opening of this control channel forms at least one control nozzle, and in event of a deviation of the ascertained spray angle from the predetermined target spray angle the volume flow of a first partial jet of the at least two partial jets is increased and the volume flow of a second partial jet of the at least two partial jets is decreased.

This determination and adjustment of the spray angle according to the invention makes it possible, in an especially advantageous manner, to realize either a continuously constant position of the spray angle during a coating process or to inspect the spray angle between two coating processes and readjust it for one or more subsequent coating processes. In this way, a longer service life of the spray device can be achieved while at the same time assuring a uniform quality of the coating. The wear on the spray device or parts of the spray device, such as its nozzles, can also be recognized in good time and possibly be compensated for, before a wear-related change in the spray angle results in a defective outcome of the process. In contrast with the prior art, where at best a deflection of the plasma jet occurs on the basis of the powder being melted which is admitted from the side into the plasma jet, in the present case a plasma jet (first gas stream) already containing the coating particles is specifically deflected by means of a second gas stream acting from the side on this first gas stream. This controlling of the first gas stream containing the coating particles by the second gas stream enables a specific adjustment of the spray angle, without in the process influencing the distribution of the coating particles in the first gas stream. Thus, the process of the mixing of the coating particles with the first gas stream is provided separately from the influencing of the spray angle in the embodiments of the present invention, as opposed to the prior art according to DE 198 20 195 A1.

It is also advantageous when the coating jet emerging from the spray device is detected with an image detection device in order to ascertain the spray angle and when the spray angle is ascertained from the detected image of the coating jet. Preferably, the image detection of the coating jet is done from the side, i.e., transversely, preferably at right angles, to the plane in which the coating jet is deflected by the spray angle. The ascertaining of the spray angle can be done especially accurately by means of the described image detection when the coating jet emerges from the spray device as a free jet.

The adjusting of the spray angle can also be done in another way, for example, by swiveling of exit nozzles for the partial jets which are provided with the exit openings or by swiveling of at least one spray nozzle for the coating jet or by providing of mechanically adjustable jet deflecting means for at least one of the partial jets and/or for the coating jet.

Preferably, the increasing of the volume flow of the first partial jet and the decreasing of the volume flow of the second partial jet is always done such that the total of the volume flows of the partial jets is constant. In this way, a changing of the spray angle by changing the volume flows of the partial jets does not result in a changing of the quality of the coating on account of an altered total volume flow.

Alternatively, the increasing of the volume flow of the first partial jet and the decreasing of the volume flow of the second partial jet is always done such that the energy content of the coating jet formed from the partial jets remains constant. The energy content of a gas jet containing coating particles is determined by the mass of the individual particles contained in a gas volume, the temperature of each particle, the velocity of each particle, and the (usually negligible) energy content of the gas.

In another advantageous embodiment of the inventive method, the angle between the axes of the exit channels is a right angle, so that the partial jets impinge on each other at right angles. In this way, the control partial jet emerging from the control nozzle with the least volume flow can already produce an effective deflecting of the coating particle partial jet containing the coating particles and emerging from the spray nozzle.

Preferably the method is designed for the thermal coating of the surface, wherein the spray device is a thermal spray device with a particle flow generator. But the method can also be designed as a kinetic coating process, wherein the particles generated in a particle flow generator are brought with very high velocity (for example, greater than 600 m/s) onto the surface being coated.

It is especially advantageous for the particle flow generator to receive the first gas stream as a gas stream enriched with coating particles which passes through the spray channel and emerges from the spray nozzle.

Advantageously, in such a method for thermal coating, the first partial jet comprising the coating particles is a plasma jet generated by a plasma burner.

In such a plasma coating process, the power of the at least one plasma burner is regulated in order to regulate the energy content of the coating jet. Such a regulating of the plasma burner in addition to the regulating of the volume flows of the two partial jets ensures in an especially reliable manner that both the energy content and the particle content in the coating jet remains constant while its spray angle is changed.

The embodiments of the invention also provide a device for adjusting a coating jet, which is especially suited to carrying out the method according to the invention. In a device according to the embodiments of the invention for coating a surface by means of a coating jet containing coating particles, in which the coating jet can be directed by a spray device at a spray angle onto the surface, means are provided with which the spray angle can be ascertained during the coating process or between two coating processes and means are provided with which the spray angle is adjustable. For this, it is provided that the spray device is provided with a spray channel for a first gas stream containing coating particles and at least one control channel for a second gas stream deflecting the first gas stream, wherein the exit opening of the spray channel forms a spray nozzle directed at the surface being coated and wherein the exit opening of the at least one control channel forms a control nozzle and wherein the gas streams emerging from the exit openings each form a partial jet and together form the coating jet, the axes of the exit channels stand at an angle to each other, and the means by which the spray angle is adjustable are means by which the volume flow of the gas stream emerging from each exit channel is adjustable.

This inventive device makes possible in an especially advantageous manner the adjustment of a coating jet both during the coating of a surface and also for calibration between two coating processes.

A preferred embodiment of the device according to the invention is characterized in that at least one image detection device is provided, which detects the coating jet, and an image evaluation device is provided, which obtains image signals provided by the at least one image detection device and determines from these the spray angle of the coating jet and/or the angle of incidence of the coating jet impinging on the surface.

It is advantageous when the means of changing the volume flow are formed by throttle devices which are adjustable by means of a respective actuating drive. Such automatically adjustable throttle devices make it possible to vary the gas streams in the control channel or in the spray channel such that the respective volume flow needed for the desired adjustment of the spray angle flows through the channels.

It is especially advantageous to provide an actuating or regulating device which applies an actuating or regulating signal to the means for changing the volume flow, especially the actuating drives of the throttle devices. This enables an automation of the process.

The regulating device in this embodiment of the device receives, as the regulated variable, the spray angle and/or the angle of incidence provided by the image evaluation device. With this data, the actuating or regulating device can then perform the necessary adjustment of the partial jets and thus adjust the spray angle of the coating jet to the desired degree or track it accordingly. Basically, it would also be possible to determine the angle of incidence of the coating jet impinging on the surface and ascertain the spray angle from this.

In an especially advantageous embodiment, the spray device is outfitted with a particle flow generator. The particle flow generator, which may comprise for example a plasma burner, a wire spray burner or a cold gas burner, generates together with the gas stream a cloud of metallic and/or ceramic particles as the coating jet. In the case of a plasma burner, a cloud of metallic and/or ceramic particles can be formed by means of the plasma in combination with the gas stream as the coating jet.

It is especially advantageous when the regulating device applies a signal to the at least one particle flow generator which regulates its particle output—in addition to the respective volume flow of the gas streams. In this way, it is possible to hold constant the particle density in the coating jet.

Further, an embodiment of the present invention is also directed to a surface coated in accordance with the inventive method. In particular, the invention is directed to a surface of a cylinder inner wall of a piston and cylinder assembly which is coated with the inventive method. It is especially advantageous for the method to be used for the coating of the running surface provided on the cylinder inner wall of a piston and cylinder assembly in an internal combustion engine, so that the outcome of the inventive method also comprises such an internal combustion engine with running surfaces coated according to the invention.

Other objects, advantages and novel features of the present invention will become apparent from the following detailed description of one or more preferred embodiments when considered in conjunction with the accompanying drawings, in which:

DETAILED DESCRIPTION OF THE DRAWINGS

Figure 1:
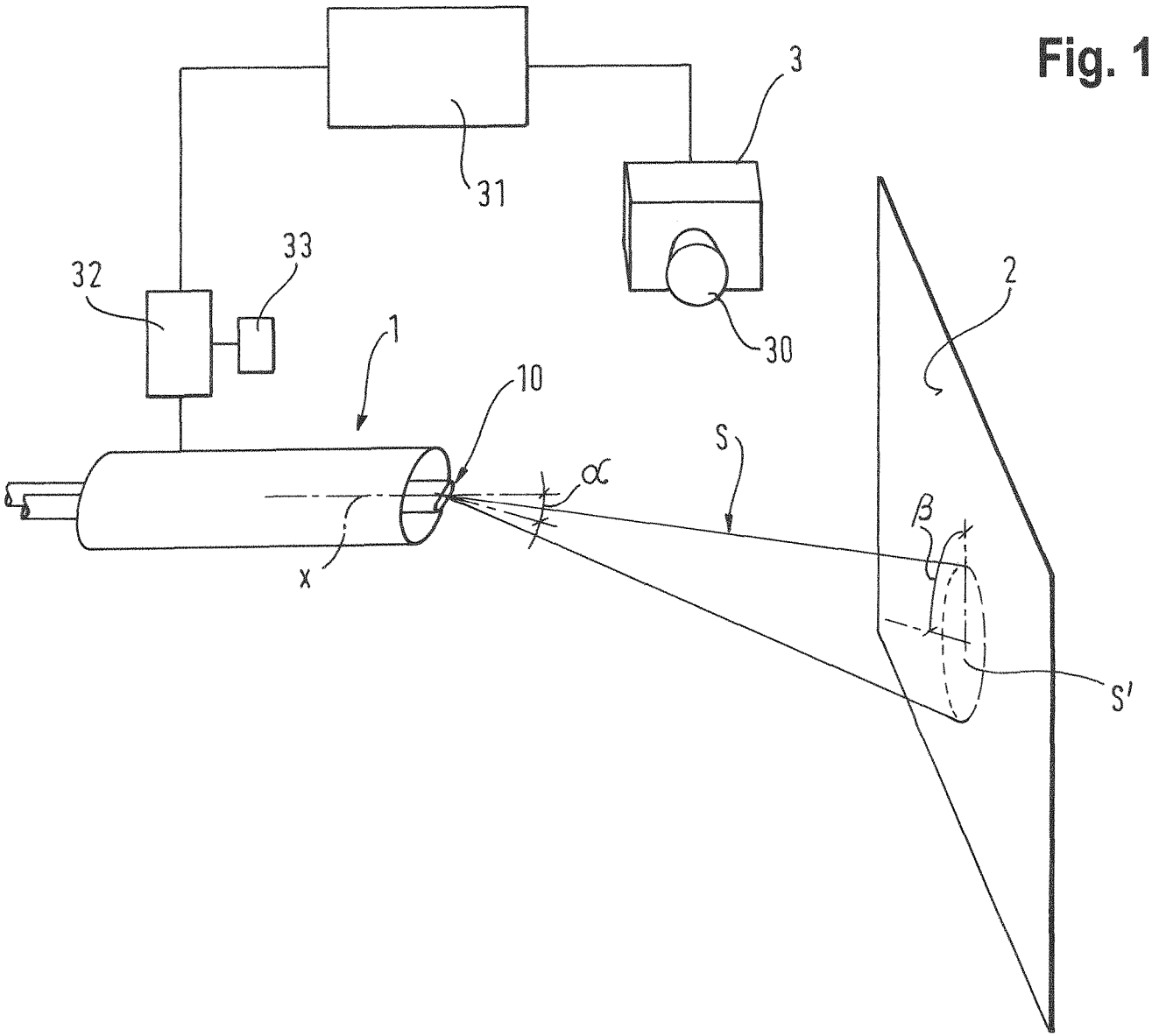
FIG. 1 is a schematic process diagram of the inventive method with the aid of a schematically represented device according to the invention.

FIG. 1 shows a process diagram of a coating installation with which an especially advantageous realization of a method according to an embodiment of the invention may be carried out to adjust a coating jet.

Figure 2:
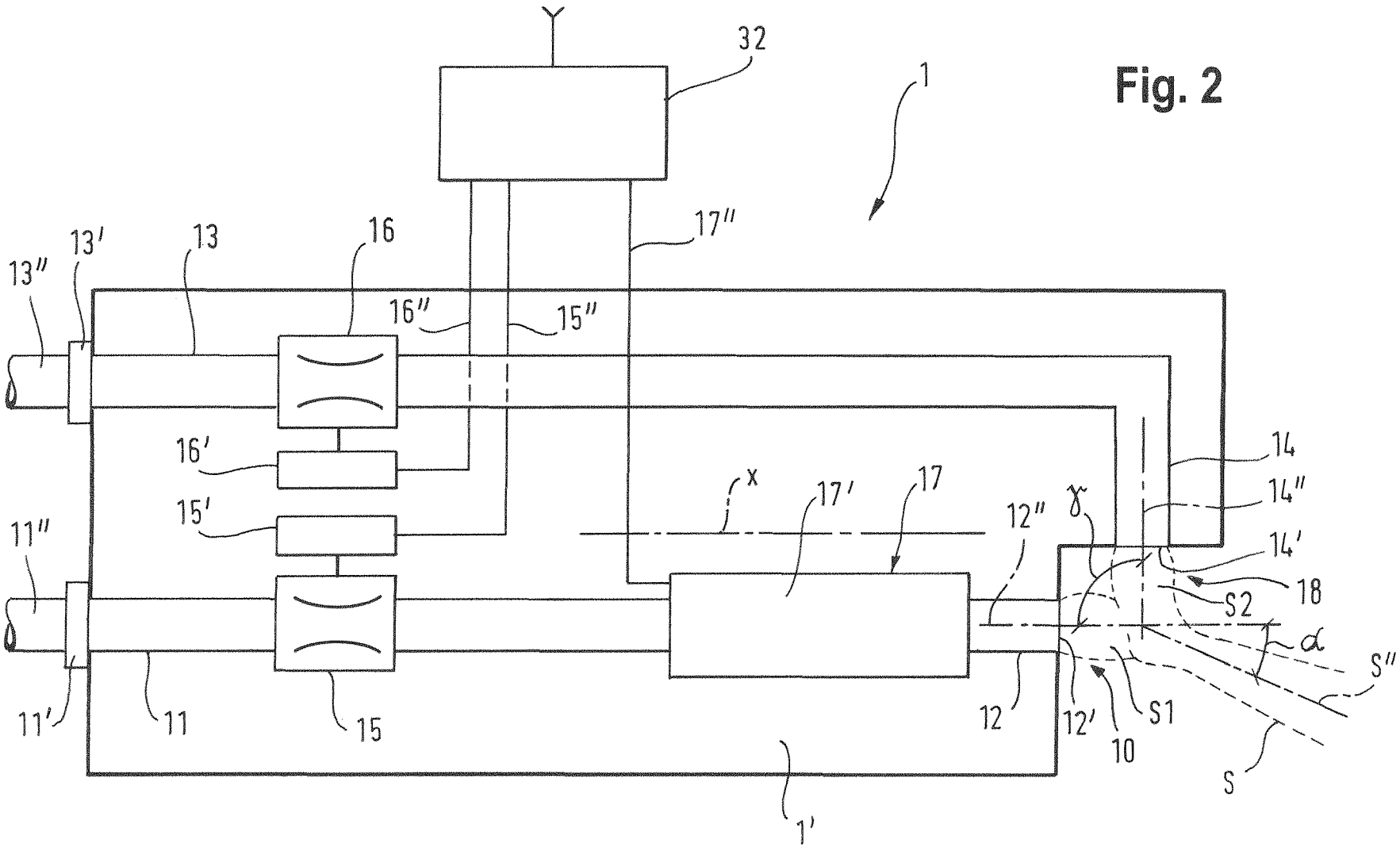
FIG. 2 is a schematically represented layout of a spray device of the device according to the invention.

A spray device 1 described more closely below in connection with FIG. 2 is arranged such that it directs a coating jet S containing coating particles from a spray nozzle 10 at a predetermined spray angle $\alpha$ onto a surface 2 being coated. The surface is preferably arranged perpendicular to a longitudinal axis x of the spray device 1.

In the example shown, an image detection device 3 is arranged between the spray device 1 and the surface 2, displaced to the side next to the coating jet S, in order to take pictures of the coating jet S. The image detection device 3 comprises a camera 30, which detects the coating jet S from the side, so that the spray angle $\alpha$ lies in an image plane photographed by the camera 30. Preferably, the camera 30 detects the entire longitudinal extension of the coating jet S from its exit from the spray device 1 to the surface 2, so that the region of impingement S' formed by the coating jet S on the surface 2 is also detected by the camera 30. Alternatively, the spray angle $\alpha$ can also be ascertained in the free jet, that is, without providing the surface 2 being coated.

The picture taken by the camera 30 is converted in the image detection device 3 into electric signals by means of an image sensor (not shown) in a manner familiar to the skilled person, which signals are sent on to an image evaluation device 31. The image evaluation device 31 analyzes the image signals and ascertains from them the spray angle $\alpha$ and thus the angle $\beta$ of impingement of the coating jet S on the surface 2. This ascertained angle data is then sent on to an actuating or regulating device 32. The actuating or regulating device 32 compares the angle or angles received (spray angle $\alpha$ and/or angle of impingement $\beta$) with an associated predetermined target spray angle stored in a storage device 33 and ascertains the corresponding angular deviation. From this angular deviation $\Delta\alpha$ between the measured actual spray angle and the target spray angle an actuating signal is generated, which is relayed to the spray device 1 and adjusts there the spray angle $\alpha$ of the spray jet S to the predetermined target spray angle in the manner yet to be described. If such an adjustment is not possible, an alarm shutdown signal is generated and preferably the further operation of the spray device 1 is prevented.

After adjusting the spray angle $\alpha$, once again a measurement is taken of the coating jet by means of the image detection device 3, so that in this way a closed feedback control loop is formed. Such a regulating process can occur during an active coating process, whereby the spray angle $\alpha$ is permanently readjusted to the predetermined target spray angle, thus ensuring a continuous quality control of the spraying process.

However, there are also situations in which such a continuous image detection of the coating jet S is not possible, for example when the coating is being done for cavities in which it is not possible to place an image detection device next to the coating jet. This is the case, for example, when coating cylinder inner wall surfaces in piston and cylinder assemblies such as those of piston-type internal combustion engines. In these cases, the described checking of the spray angle $\alpha$ is not done continuously, but instead between two coating processes. For example, a certain number of coating processes may be carried out and then a spray device 1 may be moved to a measuring and calibrating position, corresponding for example to the layout shown in FIG. 1, but where the surface 2 being coated is preferably left out and the coating jet S is measured as a free jet. In this measuring and calibrating position the spray angle $\alpha$ can then to adjusted or regulated to a predetermined target spray angle. After such a calibration process, a number of coating processes can then be carried out once more. It is especially advantageous to ascertain the compensated angular deviation during such a calibrating process and to relate this to the coating performance achieved between the two preceding calibrating processes. By extrapolating this data, it is possible to ascertain a wear trend, so that a forecast can be made as to the still remaining service life of the spray device 1 until reaching a wear limit.

A possible layout of a spray device 1 which can be used with the inventive method and the inventive device is shown schematically in FIG. 2.

The spray device 1 comprises an elongated housing 1', which extends along a longitudinal axis x of the spray device 1 and which is also called a spray lance.

In the housing 1' there are provided two channels 11, 13, which extend substantially parallel to the longitudinal axis x in the longitudinal direction through the housing 1'. At a first end of the housing 1', these channels 11, 13 emerge into a respective connection element 11', 13' for a respective associated gas supply line 11",13".

At the other end of the housing 1', the channels 11, 13 form exit channels 12, 14, each of which emerges to the outside by a respective exit opening 12',14'. The exit channels 12, 14 are not arranged parallel to each other, but rather the respective axes 12",14" of the exit channels 12, 14 are inclined at an angle γ to each other. In the example shown in FIG. 2, the angle γ amounts to around 90°.

The first channel 11, whose exit channel 12 has an axis 12" running parallel to the longitudinal axis x of the spray device 1, is provided with a particle generator 17, comprising a plasma burner 17'. This particle generator 17 receives a flow of process gas supplied by the gas supply line 11", while the particles melted by means of the plasma burner 17' are entrained by the gas stream. The process gas jet provided with these coating particles emerges at first in an axial parallel direction from the housing 1' of the spray device as a first partial jet S1 through the exit channel 12 and its exit opening 12' forming the spray nozzle 10.

A second gas supplied by the second gas supply line 13", which may correspond to the process gas or which can also simply be pressurized air, is introduced by the second channel 13 into the second exit channel 14 forming a control channel, and from here it emerges through its exit opening 14' forming a control nozzle 18 and impinges, as a second partial jet S2, on the first gas stream emerging from the spray nozzle 10 and containing the coating particles, at an angle γ. This second partial jet S2 deflects the first partial jet S1 from its axial parallel direction. The first partial jet S1 and the second partial jet S2, forming a control gas stream, are combined into a resulting coating jet S, whose jet center axis S" is inclined by the spray angle α to the axis 12" of the spray channel 12 away from the control nozzle 18 (downward in FIG. 2).

In each of the two channels 11, 13 there is provided a throttle device 15, 16 which is adjustable by means of an associated actuating drive 15',16'. By means of the first throttle device 15, which is provided in the first channel 11, the volume flow of the process gas can be regulated. By means of the second throttle device 16, which is provided in the second channel 13, the volume flow of the control gas can be regulated. The respective actuating drives 15',16' are connected by signal lines 15",16" to the actuating or regulating device 32 and can receive actuating signals from it.

The particle generator 17 is also connected by an actuating signal line 17" to the actuating or regulating device 32 and can receive actuating signals from it.

Figure 3:
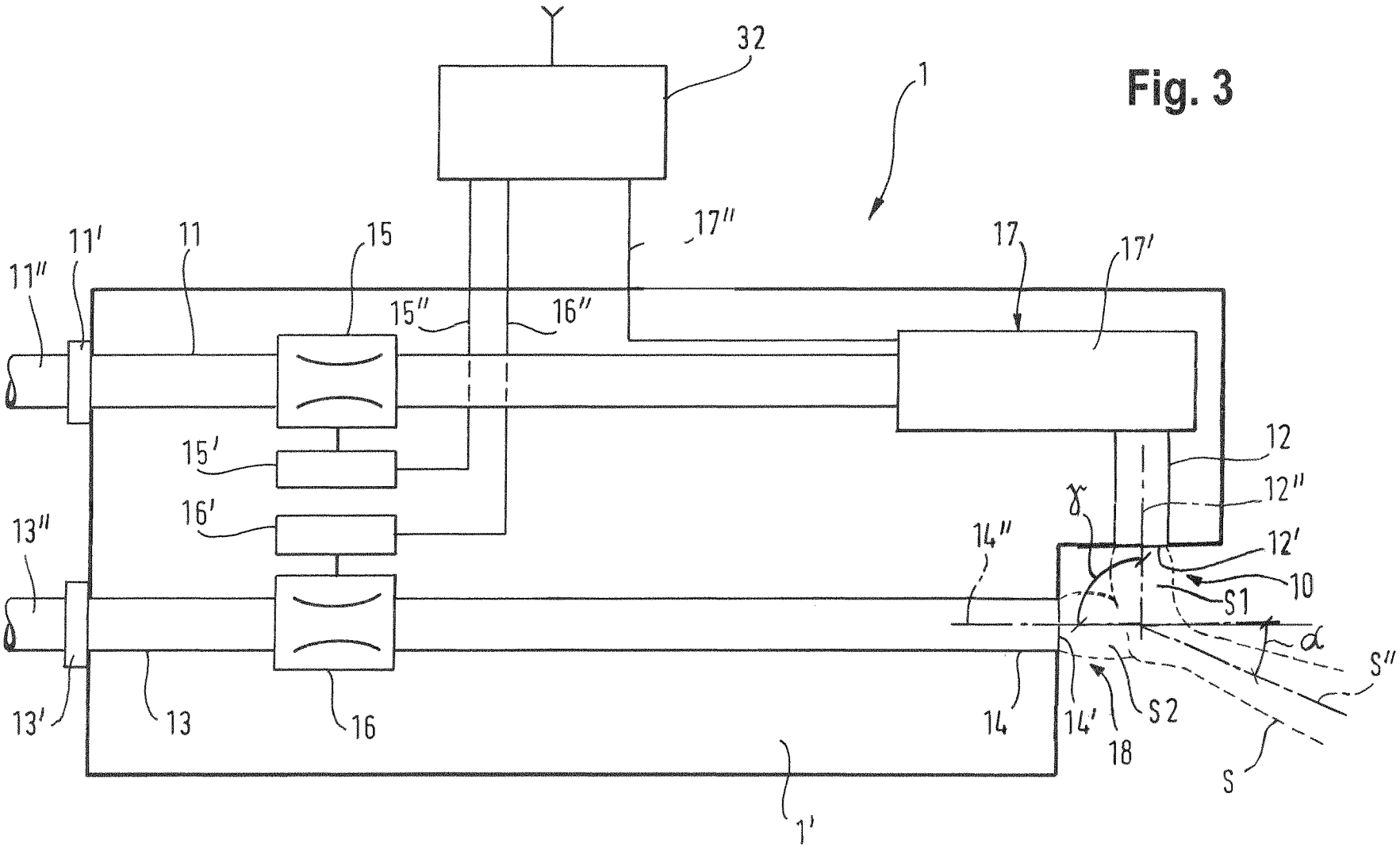
FIG. 3 is a layout of a spray device.

Even though the representation of FIG. 2 shows an example in which the gas stream laden with the coating particles emerges in a direction parallel to the longitudinal axis x of the spray device 1, variants of the spray device 1 are also conceivable in which the gas stream containing coating particles emerges at an angle to the longitudinal axis x. In an extreme case, another exemplary embodiment may be designed such that the gas stream laden with the coating particles emerges at a right angle to the longitudinal axis x, while the control gas stream emerges parallel to the longitudinal axis x. Such a variant is shown schematically in FIG. 3, where the same reference signs as in the example of FIG. 2 designate the same components.

The embodiments of the invention are not limited to the above exemplary embodiments, which serve only as a general explanation of the key notions of the invention. Instead, within the scope of its protection, the device according to the invention may also take on embodiments other than those described above. In particular, the device may have features which represent a combination of the respective individual features of the claims.

Reference signs in the claims, the description and the drawings serve merely for a better understanding of the invention and should not restrict the scope of its protection.

LIST OF REFERENCE SIGNS

1 spray device
1' elongated housing
2 surface
3 image detection device
10 spray nozzle
11 channel
11' connection element
11" first gas line
12 exit channel/spray channel
12' exit opening
12" axis
13 channel
13' connection element
13" second gas line
14 exit channel/control channel
14' exit opening
14" axis
15 throttle device
15' actuating drive
15" signal line
16 throttle device
16' actuating drive
16" signal line
17 particle flow generator
17' plasma burner
17" actuating signal line
18 control nozzle
30 lens
31 image evaluation device
32 actuating or regulating device
33 storage device
x longitudinal axis
S coating jet
S" jet center axis
S1 partial jet
S2 partial jet
α spray angle
β angle of incidence
γ angle The foregoing disclosure has been set forth merely to illustrate the embodiments of the invention and is not intended to be limiting. Since modifications of the disclosed embodiments incorporating the spirit and substance of the invention may occur to persons skilled in the art, the embodiments of the invention should be construed to include everything within the scope of the appended claims and equivalents thereof.

What is claimed is:

1. A method for coating a surface with a coating jet containing coating particles, wherein the coating jet is directed by a sprayer at a spray angle (α) onto the surface, the method comprising:

forming the coating jet from at least two partial jets, each of which emerges from an exit opening of an associated exit channel of the sprayer, wherein the respective axes of the exit channels stand at an angle (γ) to each other;

forming one of the exit channels as a spray channel for a first gas stream containing the coating particles, wherein the exit opening of this spray channel forms a spray nozzle directed at the surface being coated;

forming the other of the exit channels as a control channel for a second gas stream deflecting the first gas stream, wherein the exit opening of this control channel forms at least one control nozzle;

in case of a deviation of the ascertained spray angle (α) from the predetermined target spray angle:

increasing the volume flow of a first partial jet of the at least two partial jets, using a first structure arranged inside the sprayer, and decreasing the volume flow of a second partial jet of the at least two partial jets, using a second structure inside the sprayer, wherein the spray angle (α) is ascertained during the coating process or between two coating processes.

2. The method as claimed in claim 1, wherein the increasing of the volume flow of the first partial jet and the decreasing of the volume flow of the second partial jet is always done such that the total of the volume flows of the partial jets or the energy content of the coating jet formed from the partial jets is constant.

3. The method as claimed in claim 2, wherein the angle (γ) between the axes of the exit channels is a right angle, so that the partial jets impinge on each other at right angles.

4. The method as claimed in claim 3, wherein the method is designed for the thermal coating of the surface, and the spray device is a thermal spray device with a particle flow generator.

5. The method as claimed in claim 4, wherein the particle flow generator receives the first gas stream as a gas stream enriched with coating particles which passes through the spray channel and emerges from the spray nozzle.

6. The method as claimed in claim 4, wherein the first partial jet comprising the coating particles is a plasma jet generated by a plasma burner.

7. The method as claimed in claim 6, wherein the power of the at least one plasma burner is regulated in order to regulate the energy content of the coating jet.

8. An apparatus for coating a surface with a coating jet containing coating particles, the apparatus comprising:

a sprayer, wherein the coating jet is directeable by the sprayer at a spray angle (α) onto the surface; and an image detector (α) during the coating process or between two coating processes, wherein the spray angle (α) is adjustable, the sprayer is provided with a spray channel for a first gas stream containing coating particles and at least one control channel for a second gas stream deflecting the first gas stream, the exit opening of the spray channel forms a spray nozzle directed at the surface being coated, the exit opening of the at least one control channel forms a control nozzle, the gas streams emerging from the exit openings each form a partial jet and together form the coating jet, the axes of the exit channels stand at an angle (γ) to each other, and the spray angle (α) is adjusted by adjusting the volume flow of the gas stream emerging from each exit channel such that a volume flow of first exit channel is increased while at the same time a volume flow of a second exit channel is decreased, wherein the apparatus is configured to detect the coating just using at least one imagine, and the apparatus is also configured to obtain image signal and determine from the image signals the spray angle (α) of the coating jet and/or the angle of incidence (β) of the coating jet impinging on the surface, the volume flow of the first exit channel is increased by a first structure arranged inside the sprayer, and the volume flow of the second exit channel is decreased by a second structure arranged inside the sprayer.

9. The apparatus as claimed in claim 8, wherein the first structure and second structures are throttles which are adjustable via a respective actuating drive.

10. The apparatus as claimed in claim 9, further comprising: an actuator or regulator, which applies an actuating or regulating signal to adjust the volume flow of the gas stream emerging from each exit channel, especially actuating drives of the throttles, wherein the actuator or regulator receives, as the regulated variable, the spray angle (α) and/or the angle of incidence (β).

11. The apparatus as claimed in claim 10, wherein the sprayer, is designed as a thermal sprayer, and is outfitted with a particle flow generator, which comprises a plasma burner.

12. The apparatus as claimed in claim 11, wherein the regulating device applies a signal to the at least one particle flow generator which regulates its particle output.

13. A surface coated by a method as claimed in claim 7, wherein the surface is a surface of an inner wall of a cylinder in a piston and cylinder assembly.

14. The method as claimed in claim 5, wherein the gas stream is laden with the coating particles and emerges in a direction parallel to the longitudinal axis x of the sprayer.

15. The method as claimed in claim 1, further comprising: detecting the coating jet emerging from the spray device in order to ascertain the spray angle (α), from the side and as a free jet, wherein the spray angle (α) is ascertained from the detected image of the coating jet.

16. The method as claimed in claim 1, wherein the first structure and the second structure are disposed upstream of the exit opening.

17. The apparatus as claimed in claim 8, wherein the first structure and the second structure are disposed upstream of the exit opening.

* * * * *